United States Patent [19]

Jenkinson

[11] Patent Number: 4,789,573

[45] Date of Patent: Dec. 6, 1988

[54] DEVICE FOR PRODUCING VARIABLE MOIRE PATTERNS.

[76] Inventor: Anthony N. Jenkinson, 138 Calvert Ct., Piedmont, Calif. 94611-3438

[21] Appl. No.: 107,003

[22] Filed: Oct. 13, 1987

[51] Int. Cl.[4] ..... A47G 29/10

[52] U.S. Cl. ..... 428/28; 40/330; 40/427; 70/456 R; 428/30

[58] Field of Search ..... 428/13, 28, 30; 70/456 R; 40/6, 330, 427, 2 A

[56] References Cited

U.S. PATENT DOCUMENTS

| | | | |
|---|---|---|---|
| 2,133,081 | 10/1938 | Colvin | 40/614 X |
| 2,720,777 | 10/1955 | Kocsi | 70/456 R |
| 3,589,045 | 6/1971 | Rakowsky | 40/427 X |
| 3,633,301 | 1/1972 | Calabuig | 446/147 X |
| 3,643,361 | 2/1972 | Eaves | 40/437 |
| 4,187,628 | 2/1980 | Thompson | 40/2 A X |
| 4,330,578 | 5/1982 | Nishihira et al. | 428/28 X |
| 4,576,839 | 3/1986 | Parren | 428/13 |

*Primary Examiner*—Henry F. Epstein
*Attorney, Agent, or Firm*—Thomas R. Lampe; Glen R. Grunewald

[57] ABSTRACT

A device for producing variable moire patterns including a housing maintaining transparent sheets in face-to-face relationship, said sheets movable relative to one another and each carrying a pattern of lines.

9 Claims, 1 Drawing Sheet

DEVICE FOR PRODUCING VARIABLE MOIRE PATTERNS

TECHNICAL FIELD

This invention relates to a device which can be used for both educational and entertainment purposes.

More specifically, the device is an apparatus for producing variable moire patterns. The user of the device not only learns about the moire phenomenon but also is amused and entertained at the same time.

BACKGROUND ART

The moire effect is a well known phenomenon. Moire is a French word meaning "water" and it is commonly used to describe a water-like fabric pattern.

The moire effect occurs when lines cross one another at particular angles and examples of the phenomenon can be observed daily by an aware observer. For example, the phenomenon can be produced by common objects such as window screens and off-set railings on bridges and highways.

DISCLOSURE OF THE INVENTION

The present invention relates to a device which enables its user to observe the moire effect whenever desired and without having to wait for its random occurrence in everyday life. The device both amuses and entertains and is characterized by its relative simplicity and inexpensiveness. In the preferred embodiment disclosed herein the device also has a somewhat more practical application as a key holder.

The device of the present invention includes a plurality of substantially planar, transparent sheets, each of the sheets being of a predetermined size and carrying a pattern of lines. In the preferred embodiment, the sheets are accommodated within the interior of a housing with the sheets being maintained in face-to-face relationship. The housing interior is larger than the sheets so that when the housing is moved, relative planar movement between the sheets occurs. Such relative movement causes a corresponding continuous change in the relative positions assumed by the lines on the sheets. This will produce variable moire patterns. The housing includes at least one transparent housing wall through which these variable moire patterns may be observed.

BEST MODE FOR CARRYING OUT THE INVENTION

Figure 1:
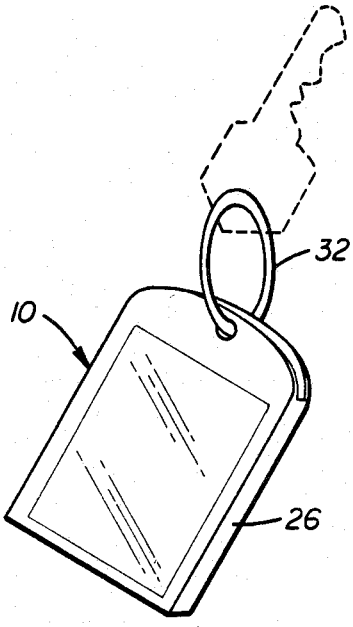
FIG. 1 is a perspective view illustrating a preferred form of apparatus constructed in accordance with the teachings of the present invention.
Figure 3:
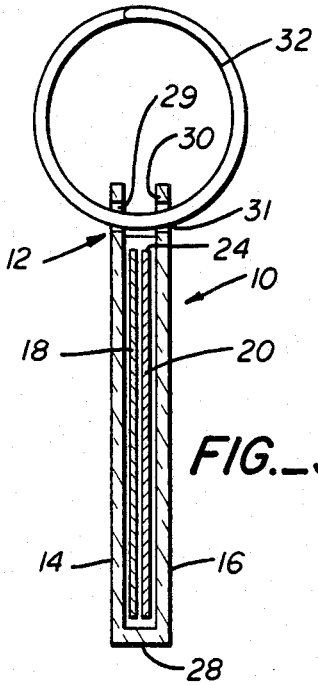
FIG. 3 is a cross-sectional view taken along the line 3—3 of FIG. 2.

Referring now to the drawings, a preferred form of device constructed in accordance of the teachings of the present invention includes a housing 10 defining an interior 12. Housing 10 is constructed of clear, rigid plastic or other suitable transparent material and includes a pair of side walls 14, 16 partially defining interior 12.

Disposed within interior 12 are transparent sheets 18, 20. In the illustrated embodiment, the sheets 18, 20 carry an identical pattern of lines in the form of concentric circles. It will be appreciated, however, that the principles of the present invention may be carried out with line patterns other than concentric circles or by employing different patterns on the transparent sheets. The sole criterion insofar as line pattern is concerned is that the lines of the patterns, when moved, produce variable moire patterns.

The sheets themselves may be formed of any suitable material. For example, the sheets may be formed of plastic or cellulosic material. In the preferred form of the invention illustrated, the line patterns are imprinted on the sheets and the lines are black. The principles of the present invention may, however, be carried out using other known techniques, such as photographic techniques to impart the line patterns and the lines themselves may be in colors other than black.

In addition to side walls 14, 16, the interior 12 is defined by auxiliary walls 24, 26, 28. Side walls 14, 16 and the sheets 18, 20 are of generally rectangular configuration and the auxiliary walls connect the side walls at three sides of the rectangular configuration.

Side walls, 14, 16 and the auxiliary walls 24, 26 define a slot 30 communicating with interior 12. Slot 30 is of a size and configuration permitting removal of transparent sheets 18, 20 from interior 12 and insertion of said sheets into the interior. Aligned apertures 29, 31 are formed in side walls 14, 16, respectively, in the vicinity of slot 30. Retention means 32 passes through both apertures, and when in such position, the retention means 32 will prevent passage of transparent sheets 18, 20 through slot 30.

In the illustrated embodiment, retention means 32 is in the form of a circular key ring of well known construction. Thus, the present device can operate as a key holder. FIG. 1 illustrates a key 34 in phantom, said key being held on key ring 32 in conventional fashion.

Figure 2:
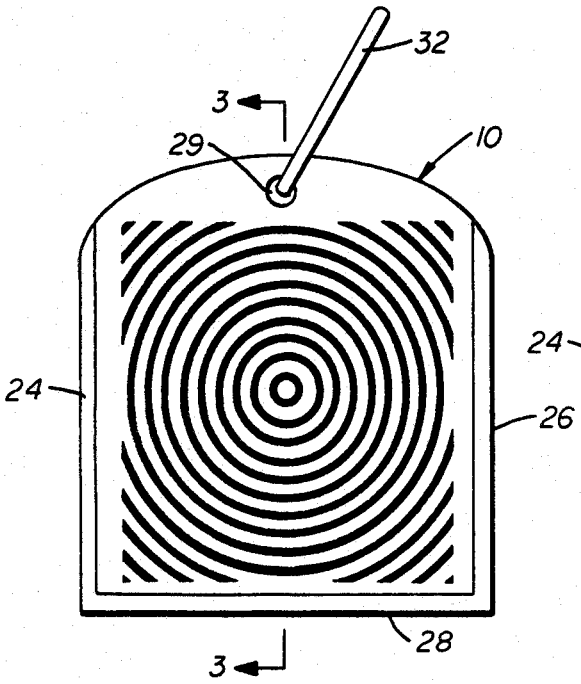
FIGS. 2 and 2A are side views of the apparatus of FIG. 1 illustrating, respectively, aligned transparent sheets carrying identical line patterns, and misaligned sheets carrying identical line patterns.
Figure 2A:
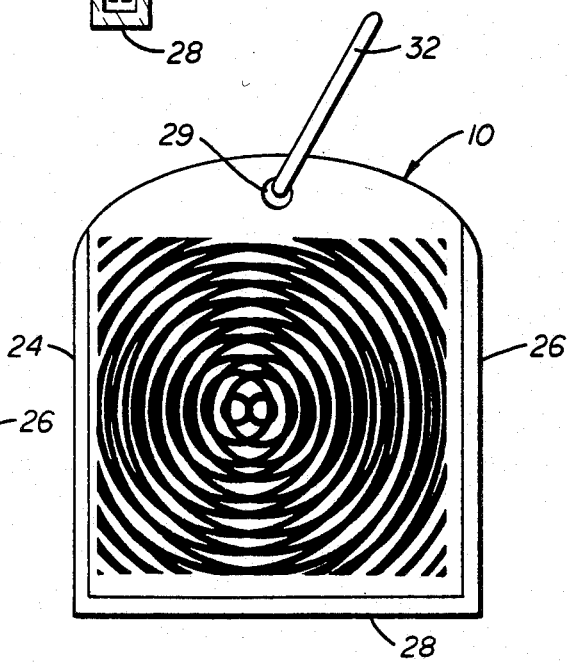

An important feature of the present invention resides in the fact that in the interior of housing 10 is sufficiently large to permit relative planar movement between transparent sheets 18, 20. When such movement occurs, as by virtue of manual manipulation of housing 10, the sheets will move relative to one another and produce variable moire patterns. A pattern produced by the lines during such movement is shown, for example, in FIG. 2A. It will be appreciated that this pattern is caused by relative displacement of the sheets. Further displacement of the sheets relative to one another from the positions they assume in FIG. 2A will produce yet another type of pattern.

Side walls 14, 16 are disposed in spaced planes generally parallel to the planes of sheets 18, 20. Furthermore, the side walls slidingly engage at least one of the sheets to restrict relative movement of the sheets to planar movement.

To produce the desired effect, at least one of the sheets 18, 20 has to be smaller than the dimensions of the housing interior so that there can be relative sheet movement. The other of the sheets could be fixed to a housing side wall, or for that matter, even comprise the side wall itself silk screened or otherwise imprinted with a pattern of lines. It is preferred however that both sheets be allowed to move within the housing interior to produce a greater variety of moire patterns. More than two sheets may be employed if desired.

What is claimed is:

1. A device comprising, in combination:

a plurality of substantially planar sheets, each said sheet being of a predetermined size and carrying a pattern of lines, at least one of said sheets being transparent whereby the other of said sheets may be observed therethrough; and a housing defining an interior and maintaining said sheets in continuous contact and in face-to-face relationship within said interior and permitting relative planar movement between said sheets whereby variable moire patterns are produced by the patterns of lines on said sheets, said housing including a pair of side walls disposed in spaced planes generally parllel to the planes of movement of said sheets and permitting observation of the variable moire patterns, said side walls restricting relative movement of said sheets to said planar movement, and auxiliary walls interconnecting said side walls and confining said sheets to said interior.

2. The device of claim 1 wherein the side walls are transparent.

3. The device of claim 1 wherein each of said sheets is smaller than said interior whereby each of said sheets is movable both relative to said housing and to the other of said sheets.

4. The device according to claim 1 wherein said side walls and said sheets are of a generally rectangular configuration and wherein said auxiliary walls interconnect said side walls at at least three sides of said rectangular configuration.

5. The device according to claim 4 wherein said side walls and said auxiliary walls define a slot communicating with said interior, said slot being of a size and configuration permitting removal of said sheets from said interior and insertion of said sheets into said interior.

6. The device according to claim 5 including retention means selectively positionable in said slot to retain said sheets in said interior.

7. The device according to claim 6 wherein said side walls define aligned apertures in the vicinity of said slot and wherein said retention means comprises a key ring selectively positionable in said apertures.

8. The device according to claim 1 wherein said housing is constructed of clear, rigid plastic.

9. The device according to claim 1 wherein said sheets are constructed of plastic and wherein said patterns of lines are imprinted on said plastic.

* * * * *